US007134424B2

(12) United States Patent
Pehrson et al.

(10) Patent No.: US 7,134,424 B2
(45) Date of Patent: Nov. 14, 2006

(54) FUEL PUMP WITH INTERNAL PRESSURE REGULATION

(75) Inventors: Alona E Pehrson, Rochester Hills, MI (US); Timothy Vernatter, Bassett, VA (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 165 days.

(21) Appl. No.: 10/843,983

(22) Filed: May 12, 2004

(65) Prior Publication Data

US 2005/0254962 A1 Nov. 17, 2005

(51) Int. Cl.
*F02M 69/54* (2006.01)
*F02M 69/00* (2006.01)

(52) U.S. Cl. ..... 123/457; 123/496

(58) Field of Classification Search ..... 123/495, 123/447, 496, 457, 446
See application file for complete search history.

(56) References Cited

U.S. PATENT DOCUMENTS 4,572,136 A * 2/1986 Takeuchi et al. ..... 123/447
5,195,487 A * 3/1993 Zurner et al. ..... 123/300
5,701,869 A * 12/1997 Richardson et al. ..... 123/497

* cited by examiner

*Primary Examiner*—Mahmoud Gimie
(74) *Attorney, Agent, or Firm*—Thomas A. Jurecko

(57) ABSTRACT

An apparatus for delivering fuel includes a fuel pump having a fuel inlet side and a fuel outlet side, and a fuel pumping mechanism operable to draw fuel from the fuel inlet side and pressurize the fuel for transmission to the fuel outlet side. A pressure regulator relieves pressure in the fuel outlet side when such pressure exceeds a predetermined maximum pressure. The pressure regulator includes a by-pass valve, a first fuel port between the fuel outlet side and the by-pass valve, and a second fuel port between the by-pass valve and the fuel inlet side. The by-pass valve is operative, in response to a pressure in the fuel outlet side in excess of the predetermined maximum pressure, to fluidly connect the first and second ports for the return of at least a portion of the fuel from the fuel outlet side to the fuel inlet side.

5 Claims, 1 Drawing Sheet

FUEL PUMP WITH INTERNAL PRESSURE REGULATION

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The invention relates generally to an apparatus for delivering fuel to an engine and more particularly to a mechanical fuel pumping apparatus with internal pressure regulation.

2. Description of Related Art

Mechanical fuel pumps in current use do not have internal pressure regulation. The fuel pressure varies for different engine operating points, being high at idle and dropping low at higher speed/load operating points. Also, during a transient event, i.e. the throttle transitions from open position to closed position, the fuel pressure spikes. This spike can cause excess fuel delivery to the engine. This is undesirable, as a rich fuel/air mixture causes the engine to operate in a non-optimal condition which effects vehicle drivability. These pressure fluctuations have been addressed using an external pressure regulator added in line between the fuel pump and the fuel/air mixer (such as a carburetor), but the external fuel pressure regulator adds to assembly complexity, parts cost, and engine compartment clutter.

It would be advantageous to provide a mechanical fuel pump with internal pressure regulation to eliminate these issues of assembly complexity and engine compartment clutter.

BRIEF SUMMARY OF THE INVENTION

An apparatus for delivering fuel to an internal combustion engine comprises a fuel pump having a fuel inlet and a fuel outlet, the fuel inlet being fluidly connected to a fuel inlet side of the fuel pump and the fuel outlet being fluidly connected to a fuel outlet side of the fuel pump, and a fuel pumping mechanism operable to draw fuel from the fuel inlet side and pressurize the fuel for transmission to the fuel outlet side. A pressure regulation unit for relieving pressure in the fuel outlet side, when such pressure exceeds a predetermined maximum pressure, is provided. The pressure regulation unit comprises a by-pass valve, a first fuel port between the fuel outlet side and the by-pass valve, and a second fuel port between the by-pass valve and the fuel inlet side. The by-pass valve is operative, in response to a pressure in the fuel outlet side in excess of the predetermined maximum pressure, to fluidly connect the first and second ports for the return of at least a portion of the fuel from the fuel outlet side to the fuel inlet side.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

The following description of the preferred embodiment is merely exemplary in nature and is in no way intended to limit the invention, its application, or uses.

Figure 1:
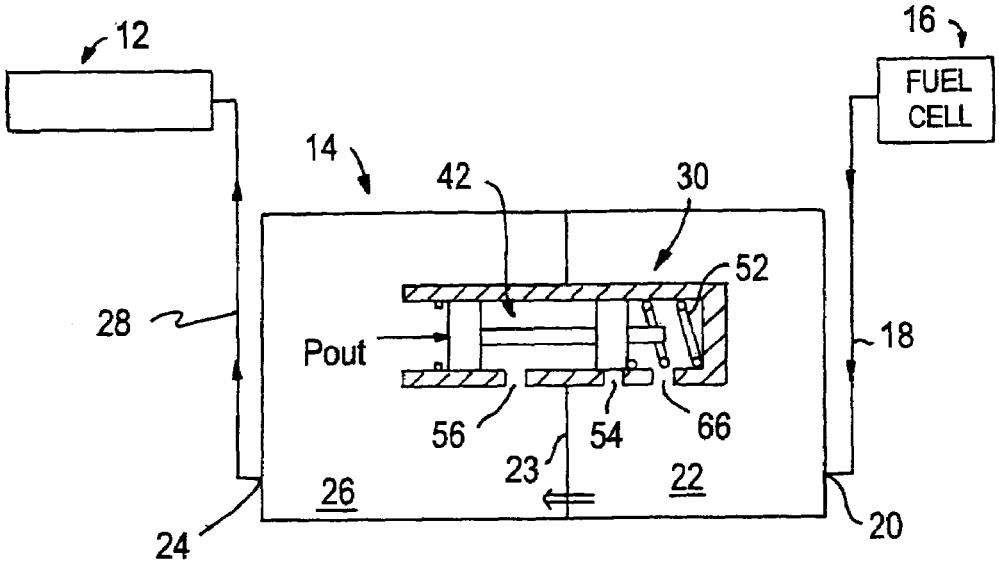
FIG. 1 is a schematic view of an apparatus for delivering fuel with internal pressure regulation according to the invention.

Referring now more particularly to the drawing, and especially to FIG. 1, there is shown an apparatus 10 for delivering fuel to a fuel/air mixing system 12, such as a carburetor, for an internal combustion engine.

The apparatus 10 includes a fuel pump 14 for pumping fuel under pressure to the mixing system 12. The fuel pump 14 receives fuel from a fuel cell 16. Fuel travels from the fuel cell 16 through a fuel line 18 into a fuel pump inlet 20 at the inlet side 22 of the fuel pump 14. Fuel pumped by the fuel pump 14 exits through a fuel pump outlet 24 at the outlet side 26 of the fuel pump and travels from the outlet 24 through a fuel line 28 to the mixing system 12.

The fuel moving from the fuel pump outlet 24 through the fuel line 28 is at a pressure above atmospheric pressure in a prescribed range. The maximum pressure in this range will vary depending on a manufacturer's preference but, for example, can be on the order of about 7 psi. During normal operating conditions, the pressure will usually stay within the prescribed range, but at times the pressure may spike, or rise above the maximum pressure in this range. In order to prevent spiking of the pressure at the pump outlet 24 and in the fuel line 28 from the pump outlet 24 to the mixing system 12, a pressure relief unit 30 is provided.

The pressure relief unit 30 comprises a by-pass valve 32 contained within the pump 14 and selectively fluidly connecting the inlet side 22 and the outlet side 26 of the pump 14. The pump inlet side 22 and pump outlet side 26 are separated by an internal barrier 23. Fuel is transferred through the barrier by any one of a number of well known mechanical fuel pumping mechanisms, such as a reciprocating diaphragm (not shown).

Figure 2:
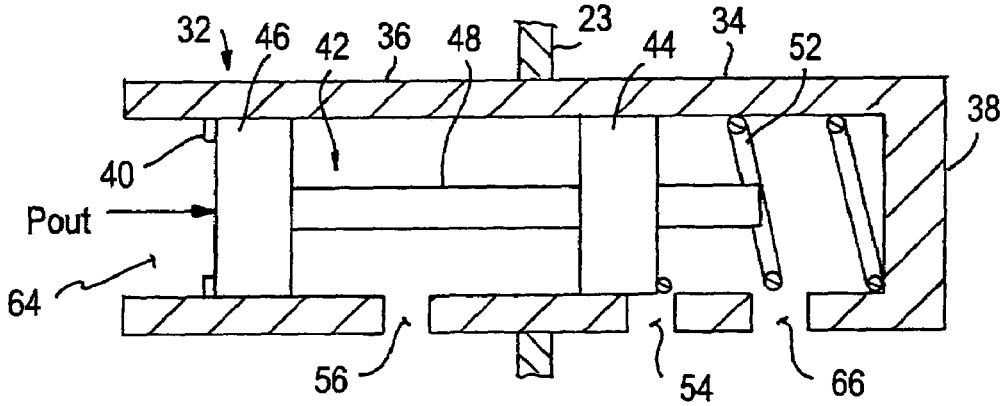
FIG. 2 is an enlarged cross-sectional view of a pressure relief unit of the apparatus of FIG. 1, in a normal operating position.
Figure 3:
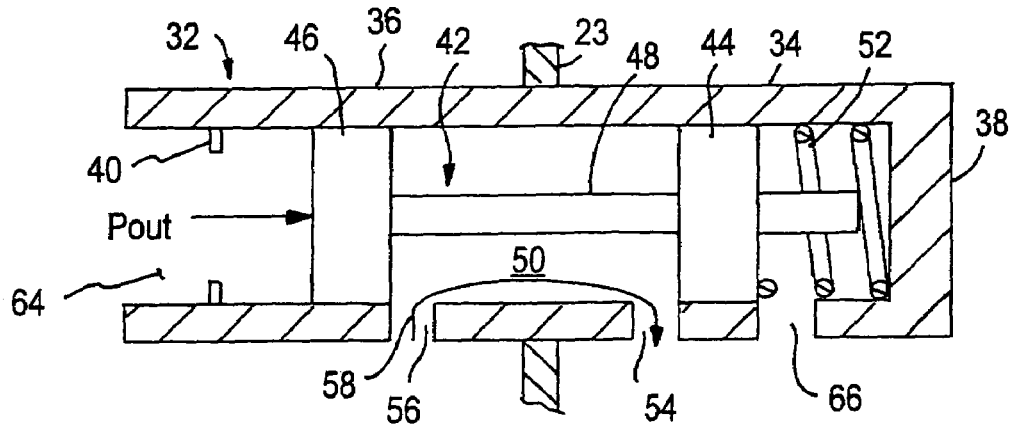
FIG. 3 is an enlarged cross-sectional view according to FIGS. 1–2, with the pressure relief unit in a pressure relief position.

Referring now to FIGS. 2–3, the valve 32 includes a housing 34 having a cylindrical side wall 36, an end wall 38 disposed at the pump inlet side 22 of the housing 34 and a stop 40 in the open end 64 of the housing 34 at the pump outlet side 26. Stop 40 can be in the form of a set screw, selectively blocking a portion of the open end 64.

The side wall 36 of the housing has axially spaced inlet and outlet side ports 54, 56, respectively. The inlet side port 54 fluidly connects the interior of housing 34 with the pump inlet side 22. The outlet side port 56 fluidly connects the interior of housing 34 with pump outlet side 26. A relief vent 66 is provided in the side wall 36 of the housing 34, proximate end wall 38.

An elongated valve element 42 is reciprocable in the housing 34 and has axially spaced, enlarged heads 44 and 46 in a sealed sliding engagement with the side wall 36 of the housing 34. The heads 44 and 46 are rigidly connected by a stem 48. Stem 48 has a reduced cross section compared to heads 44, 46, providing an open fuel transfer passage 50 between stem 48 and cylindrical wall 36, and between heads 44, 46.

A resilient member 52 in the housing 34, shown as a compression spring, is engaged between the end wall 38 of the housing 34 and the head 44 of the valve element 42. Resilient member 52 biases valve element 42 away from end wall 38 and against stop 40 in open end 64. With valve element 42 biased against stop 40, as shown in FIG. 2, head 44 blocks inlet side port 54 from fluid communication with fuel transfer passage 50.

During operation of fuel pump 14, when the outlet pressure $P_{OUT}$ at the outlet side 26 of fuel pump 14 is within a preferred operating range, resilient member 52 biases valve element 42 against stop 40, with head 44 covering inlet side port 54, as in FIGS. 1–2. Resilient member 52 is selected so that it will hold valve element 42 against stop 40 as long as $P_{OUT}$ does not exceed the preferred range.

As outlet pressure $P_{OUT}$ fluctuates, it will periodically rise above a set bypass pressure. At the bypass pressure, it is desirable to relieve the excess pressure to bring $P_{OUT}$ back within the preferred operating range. As $P_{OUT}$ exceeds the bypass pressure, the force generated against head 46 overcomes the bias of resilient member 52, and valve element 42 is displaced toward the pump inlet side 22 (to the right as shown in FIG. 3).

As valve element 42 shifts to the right, head 44 uncovers inlet side port 54. With inlet side port 54 uncovered, pump inlet side 22 is fluidly connected to pump outlet side 26 through fuel transfer passage 50, as shown in FIG. 3. Because $P_{OUT}$ is greater than the pressure in the fuel inlet side 22, fuel 58 can flow from the pump outlet side 26 to the pump inlet side 22, thereby relieving excess pressure in outlet side 26. Accordingly, spiking of pressure at the fuel outlet 24 and in the fuel line 28 is prevented. As $P_{OUT}$ falls below the bypass pressure and back within the preferred operating range, resilient member 52 overcomes the force against head 46 and returns the valve element 42 to the position of FIGS. 1–2, closing inlet side port 54.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A fuel pump for delivering fuel to an engine comprising:

a fuel pump inlet side and a fuel pump outlet side separated by an internal barrier;

a pressure regulation unit positioned inside the fuel pump intermediate the fuel pump inlet side and the fuel pump outlet side for selectively fluidly connecting the fuel pump inlet side and the fuel pump outlet side across the internal barrier, the pressure regulation unit operable to relieve a pressure in the fuel pump outlet side when the pressure exceeds a predetermined maximum pressure, wherein the pressure regulation unit further comprises a by-pass valve having a first fuel port located in the fuel pump outlet side and a second fuel port located in the fuel pump inlet side, the by-pass valve being operative to allow fuel to flow from the first fuel port to the second fuel port when the pressure in the fuel pump outlet side exceeds the predetermined maximum pressure.

2. The fuel pump of claim 1 wherein the by-pass valve comprises:

a housing and a valve element movably positioned within the housing;

the first fuel port is formed in the housing on the fuel pump outlet side; and the second fuel port is formed in the housing on the fuel pump inlet side;

wherein the valve element is movable between a first and a second position in response to the pressure in the fuel pump outlet side, the valve element arranged to fluidly isolate the first and second fuel ports when in the first position, and arranged to fluidly connect the first and second fuel ports when in the second position.

3. The fuel pump of claim 2 wherein the by-pass valve further includes a third fuel port formed in the housing to be open to the fuel pump outlet side, the third fuel port arranged to fluidly connect the fuel in the fuel pump outlet side with an end of the valve element.

4. The fuel pump of claim 3 wherein the by-pass valve further includes a resilient member for biasing the valve element in the first position.

5. The fuel pump of claim 4 wherein the valve element permits fuel to flow from the first to the second fuel port when in the second position.

* * * * *